US007686697B2

(12) United States Patent
Bussink

(10) Patent No.: US 7,686,697 B2
(45) Date of Patent: Mar. 30, 2010

(54) AMUSEMENT RIDE

(75) Inventor: Ronald Alexander Bussink, Appenzell (CH)

(73) Assignee: Ronald Bussink Amusment Design GmbH, Düsseldorf (DE)

( * ) Notice: Subject to any disclaimer, the term of this patent is extended or adjusted under 35 U.S.C. 154(b) by 40 days.

(21) Appl. No.: 11/623,972

(22) Filed: Jan. 17, 2007

(65) Prior Publication Data

US 2007/0270231 A1 Nov. 22, 2007

Related U.S. Application Data

(60) Provisional application No. 60/763,144, filed on Jan. 27, 2006.

(30) Foreign Application Priority Data

Jan. 19, 2006 (EP) ..... 06001157

(51) Int. Cl.
*A63G 31/00* (2006.01)
*B66B 7/06* (2006.01)
*A63G 1/00* (2006.01)

(52) U.S. Cl. ..... 472/131; 187/404; 187/406; 104/53

(58) Field of Classification Search ..... 104/53, 104/55, 57, 67, 127, 128, 129, 173.1, 178, 104/238, 239; 472/43, 2, 131; 187/245, 187/249, 404, 406
See application file for complete search history.

(56) References Cited

U.S. PATENT DOCUMENTS 5,036,954 A * 8/1991 Haahtikivi et al. ..... 187/406
5,566,785 A * 10/1996 Hakala ..... 187/250
5,628,690 A * 5/1997 Spieldiener et al. ..... 472/131
5,732,635 A * 3/1998 McKoy ..... 104/73
5,893,802 A * 4/1999 Bohme ..... 472/131
6,397,756 B1 * 6/2002 Saiko et al. ..... 104/53
6,460,657 B1 * 10/2002 Isenburg et al. ..... 187/245
2002/0100642 A1 8/2002 Mehrmann et al.
2002/0103033 A1 8/2002 Stengel
2004/0077415 A1 * 4/2004 Kleimeyer ..... 472/1

(Continued)

FOREIGN PATENT DOCUMENTS

BE 540 794 A 9/1955

(Continued)

*Primary Examiner*—S. Joseph Morano
*Assistant Examiner*—Jason C Smith
(74) *Attorney, Agent, or Firm*—Henry M. Feiereisen; Ursula B. Day

(57) ABSTRACT

An amusement ride includes a support structure and at least one vehicle movably supported on the support structure for carrying one or more passengers at least partially along a length of the support structure. The vehicle is moved along the support structure by a drive mechanism and decelerated by a braking mechanism. A cable connects the vehicle with the drive mechanism and/or the braking mechanism and is guided by a guide mechanism which is constructed for passage by the vehicle as the vehicle moves along the support structure. The guide mechanism includes two guide wheels in spaced-apart confronting relationship for allowing the cable to pass in-between the guide wheels, with the cable partially running over one guide wheel, when the vehicle moves along a first section of the support structure, and partially running over the other guide wheel, when the vehicle moves along a second section of the support structure.

15 Claims, 4 Drawing Sheets

U.S. PATENT DOCUMENTS

| | | | | |
|---|---|---|---|---|
| 2007/0131489 | A1 * | 6/2007 | Stalder | 187/404 |
| 2007/0261589 | A1 * | 11/2007 | Bussink | 104/53 |
| 2007/0270231 | A1 * | 11/2007 | Bussink | 472/43 |
| 2008/0093177 | A1 * | 4/2008 | Fargo | 187/249 |

FOREIGN PATENT DOCUMENTS

| | | | |
|---|---|---|---|
| DE | 842 614 | C | 6/1952 |
| DE | 198 15 768 | A1 | 11/1999 |
| DE | 19816768 | A1 * | 11/1999 |
| EP | 0 707 875 | A | 4/1996 |
| WO | WO 2004/067126 | | 8/2004 |
| WO | WO 2004067126 | A1 * | 8/2004 |

* cited by examiner

AMUSEMENT RIDE

CROSS-REFERENCES TO RELATED APPLICATIONS

This application claims the benefit of prior filed U.S. provisional Application No. 60/763,144, filed Jan. 27, 2006, pursuant to 35 U.S.C. 119(e), the content of which is incorporated herein by reference in its entirety as if fully set forth herein.

This application also claims the priority of European Patent Application, Serial No. 06 001 157.4, filed Jan. 19, 2006, pursuant to 35 U.S.C. 119(a)-(d), the content of which is incorporated herein by reference in its entirety as if fully set forth herein.

BACKGROUND OF THE INVENTION

The invention relates, in general, to an amusement ride.

Nothing in the following discussion of the state of the art is to be construed as an admission of prior art.

In the field of amusement rides, there are two different concepts for moving a vehicle that carries one or more passengers along a structure. On the one hand, roller coasters are known, which provide their entertainment to the passengers by extreme shapes of the track, for example loops or helices. Alternatively, vertical towers are known, which take their entertainment from lifting the vehicle vertically upwards to an elevated position and letting the vehicle drop vertically along a set length along the structure thereby simulating a "free fall". Such a tower is known, for example, from U.S. Pat. No. 5,628,690. A combination of a roller coaster course with a free fall tower is known from published U.S. Pat. Appl. No. 2002/0103033 A1.

For connecting the passenger vehicle of a tower with a counterweight, U.S. Pat. No. 5,628,690 describes to run a cable along the entire length of the track, i.e. from an initial loading position at the ground base to the very top of the tower and to run the cable over a series of guide wheels of a guide mechanism situated at the top of the tower. The counterweight connected to the end of the cable is arranged to run up and down inside the tower. This design leads to a cable length that is approximately of a same length as the length of the track that the vehicle runs along.

It would be desirable and advantageous to provide an improved amusement ride to obviate prior art shortcomings.

SUMMARY OF THE INVENTION

According to one aspect of the present invention, an amusement ride includes a support structure, at least one vehicle movably supported on the support structure for carrying one or more passengers at least partially along a length of the support structure, a drive mechanism for moving the vehicle along the support structure, a braking mechanism for decelerating the vehicle, a cable connecting the vehicle with the drive mechanism and/or the braking mechanism, and a guide mechanism for guiding the cable, with the guide mechanism constructed for passage by the vehicle as the vehicle moves along the support structure and including two guide wheels in spaced-apart confronting relationship for allowing the cable to pass in-between the guide wheels, with the cable adapted to partially run over one of the guide wheels, when the vehicle moves along a first section of the support structure, and to partially run over the other one of the guide wheels, when the vehicle moves along a second section of the support structure.

The invention is based on the idea of having a guide mechanism situated at a location where it is passed by the vehicle, for example at approximately half of the length of the track that the vehicle travels along. Because the guide mechanism is "overrun" by the vehicle, the cable that is connected to the vehicle and passes between the two facing guide wheels of the guide mechanism changes the direction as it leaves the guide mechanism, for example from left to right or from downwards to upwards as the vehicle runs over the guide mechanism.

Though not limited thereto, the amusement ride according to the invention may be configured in such a way that the vehicle travels from a first position to a second position and then returns to the first position. In the majority of these types of runs, the vehicle has to be slowed down as it reaches the second position or when returning to the first position from the second position. With the vehicle pulling the cable out of the guide mechanism after it has overrun the guide mechanism, this pulling action can be used to slow down the vehicle, for example by connecting a counterweight to the other end of the cable.

According to another feature of the present invention, the guide mechanism with its guide wheels is situated proximate to the part of the structure that the vehicle runs along, for example next to a rail that the vehicle runs over. However, the guide mechanism does not have to be situated proximate such a part of a structure, but can be arranged distanced to such a part as long as it is arranged in such a manner that the vehicle can pass it. The term "passing" is to be understood to mean that the vehicle crosses the plane between the two wheels.

According to another feature of the present invention, the guide wheels of the guide mechanism may be arranged in a same plane. Their axes can be orientated horizontally or vertically or at an angle either with respect to the bordering parts of the support structure (if the guide wheels are arranged in the same plane) or even with respect to each other.

According to another feature of the present invention, each of the guide wheels may have a circumferential groove to receive at least part of a cross section of the cable as it runs over the guide wheel. This allows for better guidance of the cable.

According to another feature of the present invention, the guide wheels may be arranged in such a proximate relationship that the cable is guided by the guide wheels simultaneously for a portion of the cable's passage between the guide wheels. This also allows for a better guidance of the cable.

According to another feature of the present invention, a counterweight may be connected to the cable at an end opposite to a cable end connected to the vehicle. Of course, the cable may also be connected to the drive mechanism, for example a motor driven drum that coils up the cable as it pulls the vehicle towards the guide mechanism and unwinds the cable as the vehicle travels away from the guide mechanism.

According to another feature of the present invention, a second cable may be attached to the vehicle. This second cable connects the vehicle to the drive mechanism and/or braking mechanism, while the cable that passes through the guide mechanism can be connected to a counterweight.

According to another feature of the present invention, the support structure may have the shape of a vertical standing arch that spans from a first ground base to a second ground base. The guide mechanism may hereby be suitably situated in the area of the top of the arch. Using a standing arch as support structure eliminates the presence of a space-obstructing structure in the form of a big wheel, but at the same time allows passengers to be transported to a highly elevated position. The vertical standing arch as geometric shape for the support structure is oriented essentially vertical in the area of the first ground base and the second ground base, and is orientated essentially horizontal at the top of the arch. Depending on the ground orientation at the site, where the amusement ride is to be assembled, at least one of the two ground bases could conceivably be arranged in an area, where the ground has a slope. The arch-shaped geometry of the support structure according to the invention thus is also to be understood to encompass arches, where the section of the support structure close to a ground base that stands on a sloping ground is orientated at an angle to the vertical, for example is orientated perpendicular to the sloping ground. Currently preferred is a support structure which is substantially symmetrical. Suitably, the arch is also designed to lie in one vertical plane.

The amusement ride comprises at least one vehicle which is movably supported on the support structure for carrying one or more passengers at least partially along the length of the support structure starting from an initial loading position at one of the first and second ground bases. The amusement ride according to the invention can be used to primarily shuttle the passengers from the one ground base to the other ground base while giving the passengers the enjoyment of an elevated view during shuttle operation. In such embodiment of the invention, the amusement ride has one vehicle movably supported on the support structure for carrying one or more passengers along the length of the support structure from an initial loading position at one of the first and second ground bases to an unloading position at the other ground base. The vehicle will thus shuttle from the one ground base to the other ground base. The guide mechanism is suitably arranged at the top of the arch so that the vehicle passes the guide mechanism approximately halfway on its travel from the one ground base to the other.

According to another embodiment of the invention, the amusement ride may put emphasis on a high throughput of passengers who can be provided with an elevated view. In such an embodiment, the amusement ride can have two vehicles, wherein a first vehicle is provided to travel from the first ground base along a first leg of the arch-shaped support structure to an elevated position, and a second vehicle is provided to travel from the second ground base along the second leg of the arch-shaped support structure to the elevated position. Ideally, each vehicle returns to its starting position from the elevated position. Preferably, both vehicles are operated to travel in opposite directions. For example, the one vehicle can be held in the elevated position, giving the passengers a prolonged elevated view, while at the same time passengers of the second vehicle embark and disembark at the respective ground base. Afterwards, the first vehicle is caused to travel downwards to its ground base, while the second vehicle is lifted, leading to the situation where the second vehicle is then held at the elevated position for an extended time, while passengers of the first vehicle disembark and embark at the respective ground base. Such an arrangement makes efficient use of the support structure, as the capacity to handle customers can be raised compared to previously known vertical rides. In such an embodiment, two guide mechanisms can, for example, be provided halfway along the respective path that the respective vehicle travels.

According to another feature of the present invention, the first vehicle and the second vehicle may be interconnected in such a manner that a downward movement of the one vehicle leads to an upward movement of the other vehicle. Such an arrangement results in an energy-efficient operation of the amusement ride, because the downward movement of the one vehicle can be used at least in part for lifting the other vehicle. Currently preferred is an interconnection of both vehicles by means of a cable. This can be a singular cable, with the respective vehicles being connected to the respective ends of the cable. Suitably, the cable is arranged as a cable-loop that runs along the length of the support structure and returns via a link from the first ground base to the second ground base. Thus, several cables can be used, with one cable interconnecting the two vehicles and with two separate cables connecting the vehicles to respective counterweights, for example. These two separate cables are each arranged to pass through a respective guide mechanism.

Depending on the chosen way of operating the amusement ride, the support of the vehicle(s) can be arranged in such a way as to allow the vehicle to run along the length of the support structure from the first ground base to the second ground base. For specific reasons, for example cost reasons or structural reasons, in embodiments where two vehicles are arranged to run along their respective legs of the arch, the support of the vehicles can be designed in such a way as to hinder one vehicle from completely running along the length of the support structure, but holds the vehicle always on one side of the arch.

The amusement ride according to the invention has a drive mechanism for lifting the vehicle from the loading position upwards along the support structure, and a braking mechanism for decelerating the vehicle when it travels from the elevated position in a downward direction along the support structure. Configurations of such drive and braking mechanisms are basically known from free-fall tower designs, for example from U.S. Pat. No. 5,628,690, or from known elevator constructions in buildings. For example, designs having a counterweight that is connected to the vehicle via a cable can be used. Also, known braking mechanisms, especially conventional emergency braking mechanisms for catching a free-running cable in an emergency that are especially used in building-elevator structures can also be used to provide safety to the amusement ride according to the invention.

According to another feature of the present invention, a cable may be affixed to the vehicle for lifting the vehicle. Using a cable to move the vehicle provides an efficient way for controlling the travel of the vehicle, given the technological advance that such cable-driven-systems have reached in the business of amusement rides and elevators in buildings. However, as an alternative, the vehicle may, of course, be lifted by other systems as well, for example by hydraulic cylinders.

According to another embodiment of the present invention, involving at least one vehicle connected to a cable that allows for lifting of the vehicle, the cable may be arranged as a cable-loop. This loop preferably, although not necessarily, runs along the length of the support structure and returns via a link from the first ground base to the second ground base. Preferably a driving mechanism and/or the braking mechanism are arranged to act upon the cable as it runs along the link from the first ground base to the second ground base. This allows for an easy construction, where the at times somewhat large driving and/or braking mechanisms can be arranged on the ground, for example in between the two ground bases, but still can act effectively on the cable as it runs along the link from the first ground base to the second ground base. Such an arrangement allows for the support structure to be designed without having to account for large driving and/or braking mechanisms and thus allows for the support structure to be designed as a slim arc, which is aesthetically pleasing.

According to another feature of the present invention, the link between the first base and the second base and the driving and/or braking mechanism acting on the cable as it runs along the link can be hidden in tunnels in the ground, thus further enhancing the appearance of the amusement ride.

According to another feature of the present invention, the vehicle may be moveably supported along at least one rail provided on the support structure. There are numerous ways of moveably supporting the vehicle on the support structure. For example, the vehicle can have wheels that roll along the outer surface of a support structure, with the support structure preferably being arranged in such a way that the wheels are prevented from running off the support structure. Such an arrangement of wheels is for example shown in International Publ. No. WO 2004/067126 A1. As an alternative, the support structure may have at least a singular rail, on which the vehicle is set.

According to another feature of the present invention, the support structure may be permanently secured to the ground. Suitably, the support structure is secured to the ground by means of affixing the first ground base and the second ground base permanently to the ground, for example, by providing the ground bases with a foundation. Of course, the present invention covers also designs that allow easy transport of the amusement ride.

Though the amusement ride can obviously be used as part of a fair, especially in a transportable version, the amusement ride, especially in its permanently installed embodiment can be designed as large structure, for example having a height of between 50 and 150 meters. Such constructions can for example be used as land-marks in cities, for example as creative bridges over obstructions, like rail roads or rivers. The amusement ride can for example be also used as "Entrance gate" to theme parks, allowing passengers to have an overview over the theme park.

According to another feature of the present invention, the support structure may have a hollow core. This allows elements necessary for moving the vehicles, like for example cables and counterweights, to be hidden inside the support structure, providing the support structure with a smooth look.

According to another feature of the present invention, the vehicle may have a mounting that is moveably supported on the support structure, whereby at least one passenger compartment, like a cabin for example, is attached to the mounting in a pivotable manner. Such an embodiment allows for the passenger compartment to maintain a given orientation, for example an orientation whereby the passengers are held looking horizontally. As the mounting for the passenger compartment travels along the support structure, the pivotable holding of the passenger compartment allows for the passenger compartment to adopt to the change of orientation of the mounting, that is dependent on the changing orientation of the support structure along its length, i.e. from a vertical orientation in the area of the ground bases to a horizontal orientation on the top of the arch.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
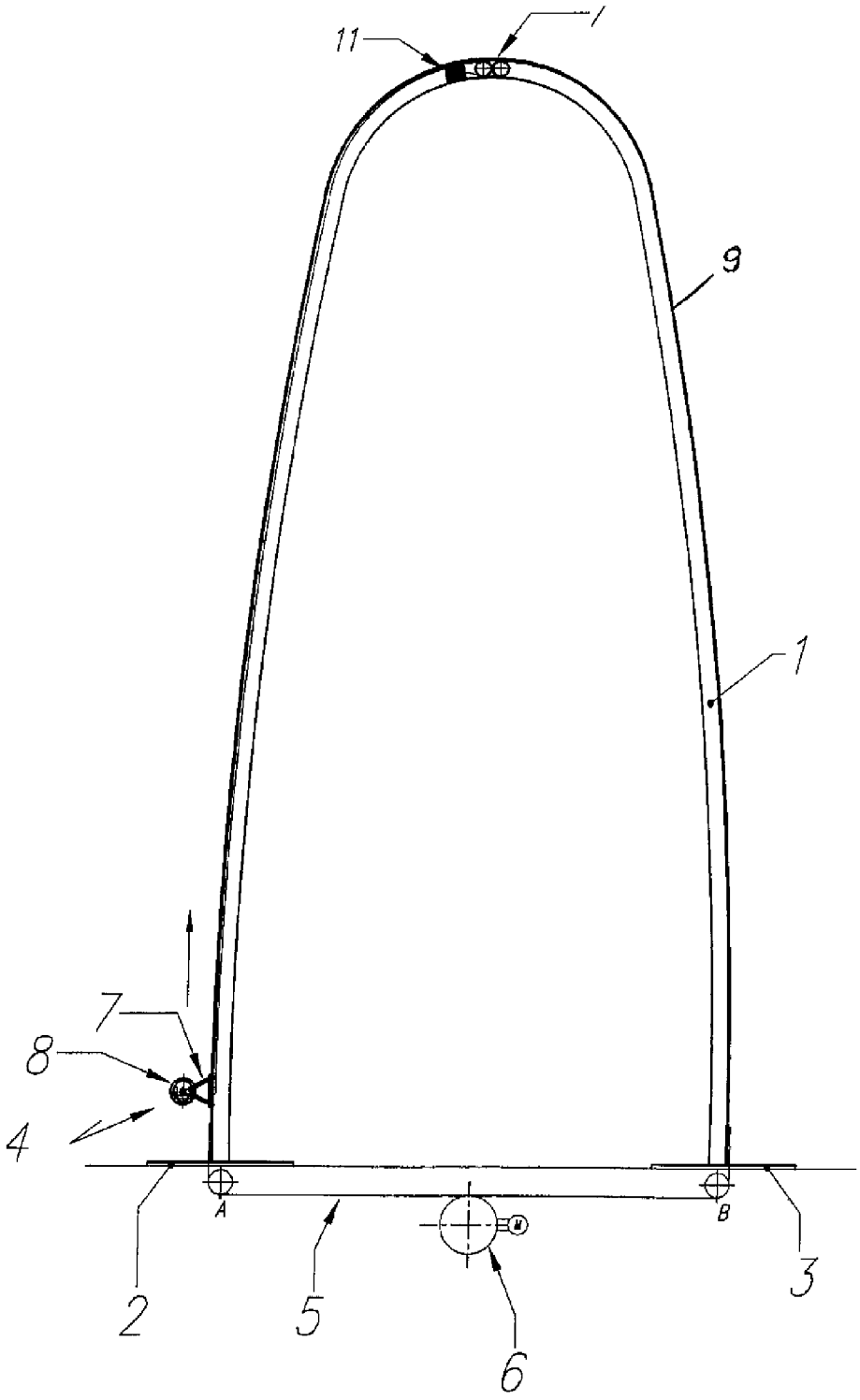
FIG. 1 is a schematic side view of a first embodiment of an amusement ride according to the present invention, depicting a vehicle in a first position.

Throughout all the Figures, same or corresponding elements are generally indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

In this context, reference is made to commonly assigned copending patent application by the same inventive entity, entitled "Amusement Ride", filed Dec. 20, 2006 and having been assigned application Ser. No. 11/613,546, the disclosure of which is incorporated herein by reference in its entirety as if fully set forth herein.

Turning now to the drawing, and in particular to FIG. 1, there is shown a schematic side view of a first embodiment of an amusement ride according to the present invention, including a support structure 1 having the shape of a vertical standing arch that spans from a first ground base 2 to a second ground base 3. A vehicle 4 is movably supported on the structure 1 for carrying one or more passengers at least partially along the length of the support structure 1 from an initial loading position at the first ground base 2.

A cable 9 is affixed to the vehicle 4 and runs along the length of the support structure 1 and returns via a link 5 from the first ground base 2 to the second ground base 3. In the embodiments shown here, the link 5 is designed as an underground tunnel.

A motor 6 is provided to act upon the cable 9 as it runs along the link 5 from the first ground base 2 to the second ground base 3. Together with the motor 6, the cable 9 acts as a drive mechanism for lifting the vehicle 4 from the loading position upwards along the support structure 1 and—with the motor 6 being used as a generator—acts as braking mechanism for decelerating the vehicle 4 when it travels from an elevated position in a downward direction along the support structure 1.

The vehicle 4 is movably supported on the support structure 1 by a mounting 7 and has at least one passenger compartment in the form of a capsule 8, which is attached to the mounting 7 in a pivotable manner.

Furthermore, a second cable 14 is affixed to the vehicle 4 and extends along the support structure 1 from the vehicle 4 via a guide mechanism 10 at the top of the arch to a counterweight 11, which, as shown in FIG. 1 is held close to the guide mechanism 10 as the vehicle 4 is situated close to the first ground base 2.

Figure 2:
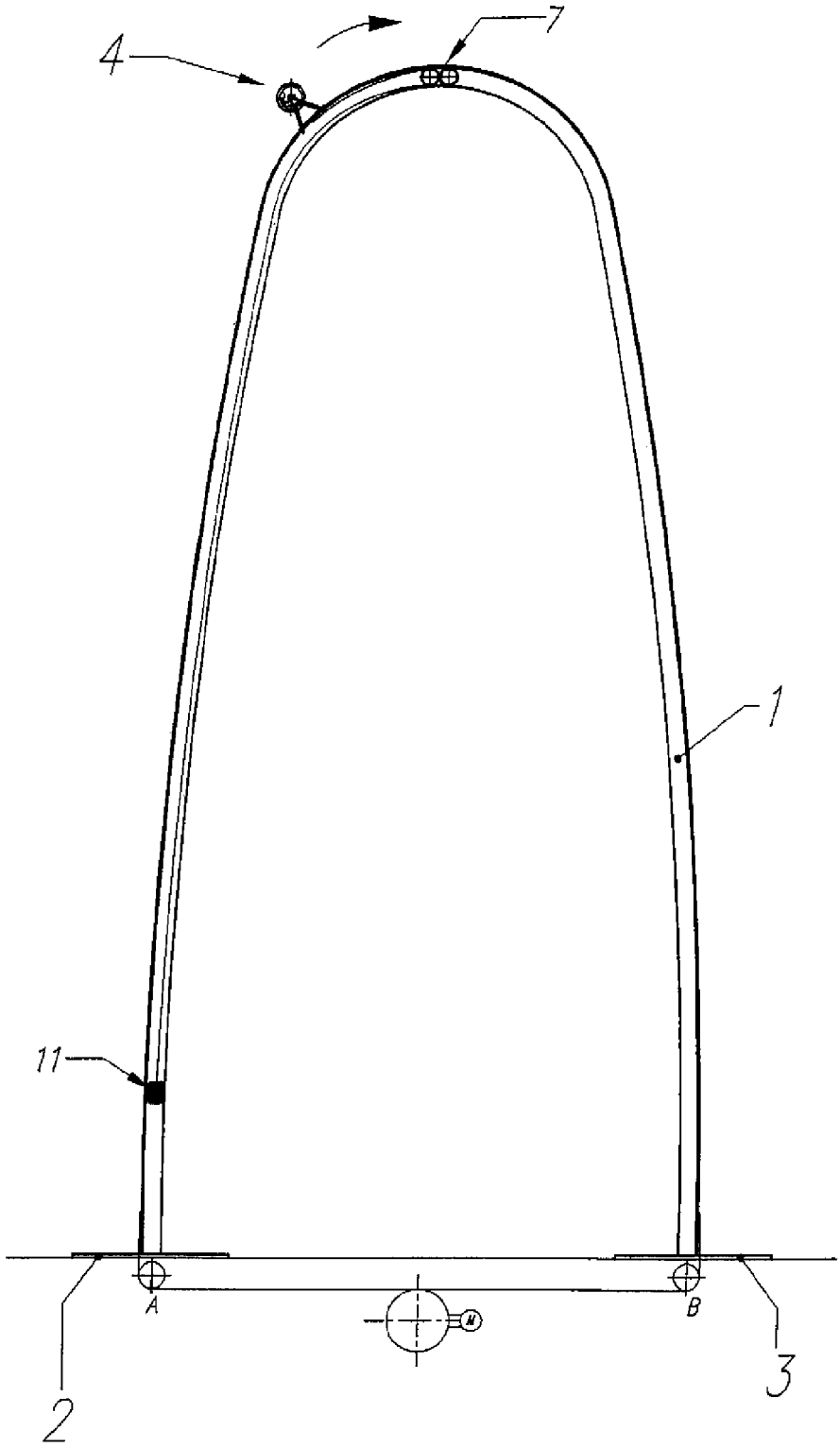
FIG. 2 is a schematic side view of the amusement ride of FIG. 1, depicting the vehicle in a second position.
Figure 3:
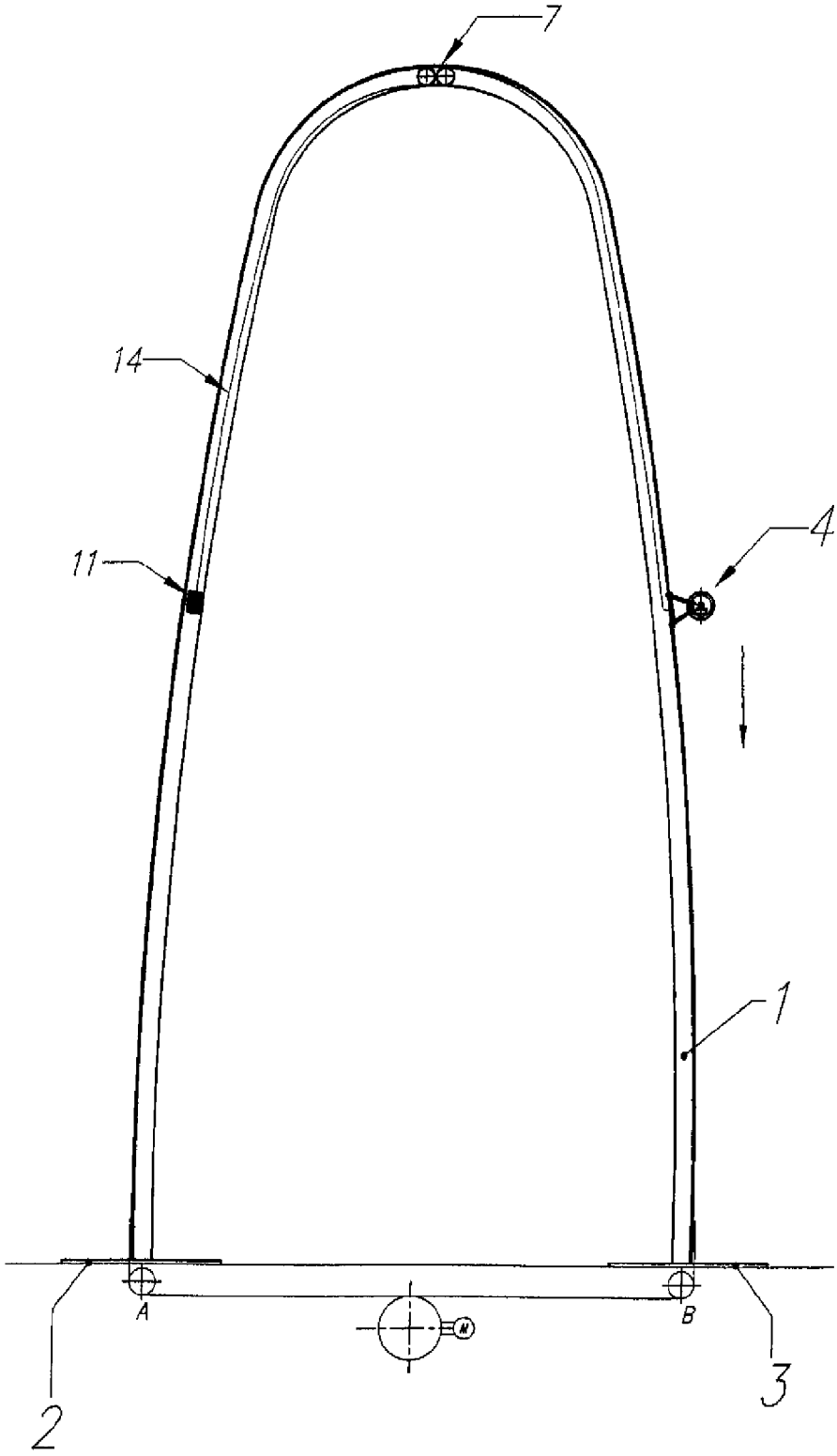
FIG. 3 is a schematic side view of the amusement ride of FIG. 1, depicting the vehicle in a third position.

As can be seen from FIGS. 1, 2 and 3, when viewed in sequence, the vehicle 4 of the amusement ride is moved along the support structure 1 from the first ground base 2 to the second ground base 3, operating as a shuttle from the one ground base to the other ground base. Having reached the second ground base 3, passengers can disembark and new passengers can embark, making the second ground base 3 the new initial loading position. The vehicle 4 then returns to the first ground base 2 by traveling back along the support structure 1.

As the vehicle 4 moves upwards from the first ground base 2 towards the top of the arch, the counterweight 11 is lowered as shown in FIG. 2. As the vehicle 4 travels over the top of the arch, the vehicle 4 passes the guide mechanism 10. As the vehicle 4 travels down the other side of the arch, the vehicle 4 starts to pull the counterweight 11 upwards and is thereby slowed down in its movement.

As can be seen when looking at the capsule 8 and a standing passenger depicted therein, arranging the capsule 8 in a pivotable manner on the mounting 7 allows the capsule 8 to maintain its overall orientation, thereby allowing the passenger to remain in a standing position, as shown in the Figures.

Figure 4:
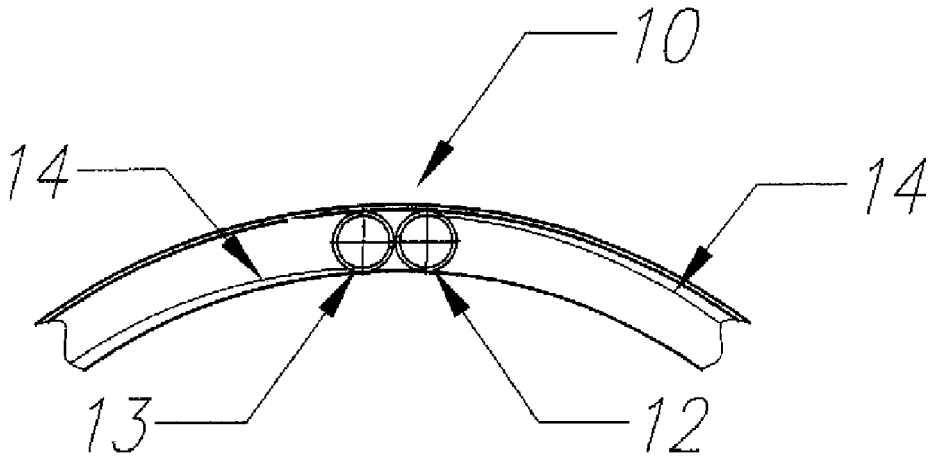
FIG. 4 is a fragmentary schematic view, on an enlarged scale, of a guide mechanism according to the present invention.

Turning now to FIG. 4, there is shown an enlarged view of the guide mechanism 10. The guide mechanism 10 has two facing guide wheels 12, 13 with the cable 14 arranged to pass in-between the facing guide wheels 12, 13. The cable 14 partially runs over the one guide wheel 13 in its lower section that is in the section facing away from the section that is proximate to the path that the vehicle 4 runs along. The cable 14 also partially runs over the other guide wheel 12 in its upper section, because the vehicle 4 has overrun the guide mechanism 10 and is travelling along the track on the right-hand side of the guide mechanism 10 (not shown).

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An amusement ride, comprising:

a support structure;

at least one vehicle movably supported on the support structure for carrying one or more passengers at least partially along a length of the support structure;

a drive mechanism for moving the vehicle along the support structure;

a braking mechanism for decelerating the vehicle;

a cable connecting the vehicle with the drive mechanism and/or the braking mechanism; and a guide mechanism for guiding the cable, said guide mechanism constructed for passage by the vehicle as the vehicle moves along the support structure and including two guide wheels in spaced-apart confronting relationship for allowing the cable to pass in-between the guide wheels, with the cable adapted to partially run over one of the guide wheels, when the vehicle moves along a first section of the support structure, and to partially run over the other one of the guide wheels, when the vehicle moves along a second section of the support structure.

2. The amusement ride of claim 1, wherein each of the guide wheels has a circumferential groove to receive at least part of a cross section of the cable as it runs over the guide wheel.

3. The amusement ride of claim 1, wherein the guide wheels are arranged in close side-by-side relationship so that the guide wheels jointly guide the cable along a cable portion extending between the guide wheels.

4. The amusement ride of claim 1, further comprising a counterweight connected to the cable at an end opposite to a cable end connected to the vehicle.

5. The amusement ride of claim 1, wherein the support structure generally has the shape of a vertical standing arch that spans from a first ground base to a second ground base, said guide mechanism being positioned at a top area of the arch.

6. The amusement ride of claim 5, wherein the vehicle on the support structure, the drive mechanism and the braking mechanism are constructed to allow the vehicle to be moved from the initial loading position at one of the first and second ground bases to an unloading position at the other one of the first and second ground bases.

7. The amusement ride of claim 5, wherein the vertical standing arch is oriented essentially vertical in an area of the first ground base and the second ground base, and orientated essentially horizontal at the top area of the arch.

8. The amusement ride of claim 1, further comprising at least one rail mounted to the support structure, wherein the vehicle is movably supported along the at least one rail.

9. The amusement ride of claim 1, wherein the support structure is fixedly secured to the ground by affixing the first ground base and the second ground base permanently to the ground.

10. The amusement ride of claim 1, wherein the support structure has a hollow core.

11. The amusement ride of claim 1, wherein the vehicle has a mounting which is movably supported on the support structure and has at least one passenger compartment attached to the mounting in a pivotable manner.

12. The amusement ride of claim 1, further comprising a further said vehicle, wherein the at least one vehicle is caused to travel from the first ground base along a first leg of the support structure to an elevated position and the further vehicle is caused to travel from the second ground base along the second leg of the support structure to the elevated position.

13. The amusement ride of claim 12, wherein the at least one vehicle and the further vehicle are interconnected in such a manner that a downward movement of the one of the vehicles leads to an upward movement of the other one of the vehicles.

14. The amusement ride of claim 1, wherein the guide wheels of the guide mechanism are arranged in a same plane.

15. The amusement ride of claim 14, wherein the guide wheels define axes which are orientated horizontally or vertically or at an angle.

* * * * *

UNITED STATES PATENT AND TRADEMARK OFFICE

CERTIFICATE OF CORRECTION

PATENT NO. : 7,686,697 B2
APPLICATION NO. : 11/623972
DATED : March 30, 2010
INVENTOR(S) : Ronald Alexander Bussink It is certified that error appears in the above-identified patent and that said Letters Patent is hereby corrected as shown below:

On the Title page:

[73] Assignee: replace "Ronald Bussink Amusment Design GmbH" with the correct --Ronald Bussink Amusement Design GmbH--.

Signed and Sealed this

Eleventh Day of May, 2010

David J. Kappos

David J. Kappos
*Director of the United States Patent and Trademark Office*